US009550307B2

(12) United States Patent
Buettner et al.

(10) Patent No.: US 9,550,307 B2
(45) Date of Patent: Jan. 24, 2017

(54) DISCHARGING WORKPIECES

(71) Applicant: TRUMPF Werkzeugmaschinen GmbH + Col. KG, Ditzingen (DE)

(72) Inventors: Stefan Buettner, Bad Groenenbach (DE); Stefan Kerscher, Walzbachtal (DE); Wolfgang Laib, Besigheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 14/224,633

(22) Filed: Mar. 25, 2014

(65) Prior Publication Data

US 2014/0290453 A1 Oct. 2, 2014

(30) Foreign Application Priority Data

Mar. 27, 2013 (DE) ..... 10 2013 103 121

(51) Int. Cl.
*B26D 7/18* (2006.01)
*B21D 43/10* (2006.01)
*B26D 7/32* (2006.01)

(52) U.S. Cl.
CPC ..... *B26D 7/1863* (2013.01); *B21D 43/105* (2013.01); *B26D 7/18* (2013.01); *B26D 7/32* (2013.01); *Y10T 83/0448* (2015.04); *Y10T 83/0467* (2015.04); *Y10T 83/2183* (2015.04); *Y10T 83/2185* (2015.04)

(58) Field of Classification Search
CPC ... B21D 43/105; B26D 7/1863; B26D 7/1854; Y10T 83/0467; Y10T 83/2185
USPC ..... 83/27, 153, 23, 152, 151
See application file for complete search history.

(56) References Cited

U.S. PATENT DOCUMENTS

| | | | | |
|---|---|---|---|---|
| 3,728,921 | A * | 4/1973 | Vogel | 83/151 |
| 3,769,866 | A * | 11/1973 | Pietrucci et al. | 83/302 |
| 4,930,976 | A * | 6/1990 | Spacher et al. | 414/744.8 |
| 5,189,934 | A * | 3/1993 | Davidson et al. | 83/153 |
| 5,463,921 | A * | 11/1995 | Bellio et al. | 83/151 |
| 6,024,003 | A * | 2/2000 | Newman | B23K 26/0853 83/100 |
| 6,823,763 | B1 * | 11/2004 | Foster et al. | 83/100 |
| 7,950,708 | B2 * | 5/2011 | Parnell | 294/2 |
| 8,905,662 | B2 * | 12/2014 | Richards et al. | 400/621 |
| 2001/0003936 | A1 * | 6/2001 | Song | 83/24 |
| 2007/0240547 | A1 * | 10/2007 | Dick et al. | 83/76.1 |
| 2010/0040450 | A1 | 2/2010 | Parnell | |
| 2010/0313722 | A1 * | 12/2010 | Fastert et al. | 83/24 |

FOREIGN PATENT DOCUMENTS

| | | | |
|---|---|---|---|
| DE | 102006023885 | A1 | 10/2007 |
| EP | 0128487 | A1 | 12/1984 |
| EP | 1967301 | A1 | 9/2008 |

* cited by examiner

*Primary Examiner* — Stephen Choi
*Assistant Examiner* — Fernando Ayala
(74) *Attorney, Agent, or Firm* — Fish & Richardson P.C.

(57) ABSTRACT

A method of discharging workpieces cut from a planar material on a processing machine. A workpiece discharge device has several holding elements to receive and carry respective workpieces. After receiving a cut workpiece, the discharge device is moved to a waiting position outside and adjacent a processing region of the machine, and may then be moved back into the processing region to receive a subsequently cut workpiece before being moved to an unloading station.

11 Claims, 4 Drawing Sheets

DISCHARGING WORKPIECES

The invention relates to discharging workpieces cut from a planar material on a workpiece support.

BACKGROUND

During processing of planar material, it is known to discharge each produced workpiece from the processing region individually, with the workpiece discharged with a discharge device after being cut free, and then being supplied to an unloading station. The cycle time required for the discharge and unloading of the workpiece can be greater than for the time required to cut out a subsequent workpiece. This can lead, particularly in the case of small workpiece parts, to waiting times and to deterioration of the degree of automation.

Reductions in cycle time, and corresponding improvements in productivity, are sought, particularly in skeleton-free processing of planar materials.

SUMMARY

The invention provides a method in which, after a first workpiece is cut apart, a discharge device having a holding element is positioned in a receiving position for the first work piece, receives the workpiece, and subsequently is moved to a waiting position outside the receiving position and adjacent the processing region, such that, after a further workpiece is cut, the discharge device may be moved from the waiting position to the receiving position in order to discharge the further workpiece with a further holding element of the discharge device, and subsequently be moved again from the receiving position to the waiting position. The discharge device is moved to an unloading station after receiving at least two workpieces, one after the other, or after the complete processing of the planar material. Thus the cycle times for the discharge of the workpieces from the processing region can be fundamentally shortened, as the discharge device remains in a waiting position adjacent the processing region until a plurality or all holding elements of the discharge device bear a respective workpiece, in order to subsequently carry out only one movement between the waiting position and the unloading station, and then deposit a plurality or all received workpieces into the unloading station. Thus a discharge of several parts from the processing region is carried out, in which the discharge device is moved many times between the receiving position and the adjacent waiting position, and only moves to the unloading station after the receiving of several workpieces or after the complete processing of the planar material.

Thus, in the case of skeleton-free processing and also in the case of processing with skeletons, a fundamentally shorter cycle time can be enabled than in the case of the production of workpieces which are led away individually to the unloading station after being separated from the planar material of the workpiece and leaving a left over workpiece.

A preferred embodiment of the method provides that the workpiece is first cut so as to leave only a residual connection to the remaining planar material. The discharge device is moved to the receiving position for the workpiece, the workpiece is fixed with the holding element of the discharge device, and then the workpiece is cut free before being discharged from the processing region. This enables a secure gripping of the workpiece with the holding element of the discharge device and a secure discharge from the processing region.

Furthermore, preferably after the workpiece is cut free, the discharge device having the received workpiece is lifted in the Z-direction and is moved in the X-direction, Y-direction or X/Y-direction to a subsequent receiving position for a subsequent workpiece or to a waiting position, while processing to produce the subsequent workpiece is implemented. Short cycle times can thus be achieved.

In some cases the movement path of the discharge device to the subsequent receiving position is adjusted to the X-axis dimension of the subsequent workpiece. Thus, a reduction of the movement path can be achieved.

In some embodiments the movement path of the discharge device to the subsequent receiving position is oriented along a dimension in which the holding elements of the discharge device are spaced. Thus it can be ensured that each free holding element is supplied to the most recently produced workpiece with a short movement path, and a secure discharge is enabled.

The workpieces are preferably produced successively along a lateral edge of the planar material, which is directed outward with regard to the processing device, which may be immovable, and the workpieces are received one after the other and in the same order by the holding elements of the discharge device. Thus the workpieces can also be deposited in the unloading station in the same order, whereby a classification and sorting of individual workpieces is simplified, if, for example, these differ from one another in size.

In some cases the movement path between the waiting position and the receiving position is determined by the contact spacing of the holding element and the size of the workpieces. If, for example, a discharge device having holding elements has the same longitudinal extension as the planar material, the planar material is transported in the X-direction on the same path as the discharge device is moved.

To unload the workpiece received by the discharge device, the workpieces are preferably all deposited in the unloading station simultaneously or are deposited individually one after the other, preferably in one stack. The mutual depositing of all workpieces simultaneously has a time advantage compared to stacking the workpieces.

To further increase productivity, the workpieces that are cut free may be stored in an intermediate buffer of the discharge device after the discharge. Thus a plurality of workpieces can be stored in a relatively compact discharge device.

Furthermore, the successive cutting-apart of the workpieces is preferably carried out by skeleton-free processing of the planar material. This is a particularly advantageous embodiment, and is particularly useful if the discharge device has holding elements that are not able to move individually in the Z-axis. This skeleton-free processing can also be required if collision monitoring is not possible in the Z-direction.

Another aspect of the invention features a processing machine to process a planar material. The machine has a discharge device with several holding elements, by which the workpieces are able to be discharged from a processing region of the processing machine one after the other. The discharge device is configured to be positioned in a waiting position adjacent the processing region, and the holding elements are configured to be controlled one after the other to receive the further workpieces. Thus, the discharge device is configured to be moved several times from a waiting position to a receiving position in order to receive a further workpiece after each respective workpiece is cut apart, until all receiving positions of the discharge device are occupied, in order to subsequently transfer the received workpieces to the unloading station together.

Preferably the discharge device has at least two holding elements arranged in a line one behind the other. Thus, a narrow and elongated discharge device can be provided, which can extend over the entire length of the planar material, such that all workpieces, which are processed in a line one behind the other, can be received and transferred to the unloading station.

Furthermore in some embodiments the discharge device has two or more rows of holding elements that are aligned in parallel. A back row of the holding elements, arranged towards the lateral edge of the planar material, is first controlled, and subsequently a more forward row of the holding elements is controlled.

The holding elements of the discharge device are preferably designed as suction grippers or vacuum suction grippers.

In some embodiments at least one holding element of the discharge device is configured to move along the Z-axis. Preferably, all holding elements of the discharge device are configured to move individually. This has the advantage that the discharge device is able to be positioned in the receiving position above the workpiece to be discharged, and only the holding element that discharges the workpiece is dropped. Thus both skeleton-free processing and processing with a skeleton is enabled. In particular the processing with a skeleton is not disturbed during the discharge due to this design.

In some embodiments the discharge device comprises unloading equipment or a handling robot, by which the workpieces are discharged and supplied to the temporary storage. Through individual discharge of the workpieces by means of handling robots, a good accessibility to discharge the workpiece in the receiving position can be provided. Additionally, a simple transfer of the workpieces to an intermediate buffer can occur. For example, an intermediate buffer can be formed above a suction frame for the discharge device.

In some cases, the discharge device includes an intermediate buffer. By this the number of movement paths between the waiting position and the unloading and loading position can be further reduced.

In some embodiments the discharge device of the processing machine has a chain or a band having several suckers arranged thereon. Thus, for example, a workpiece can be discharged with each sucker, or with each sucker group in turn, such that an intermediate buffer can be created in turn.

The invention as well as further advantageous embodiments and developments of the same are described and explained in more detail in the following by means of the examples depicted in the drawings. The various features disclosed in the description and the drawings can be applied individually or in combination.

DETAILED DESCRIPTION

Figure 1:
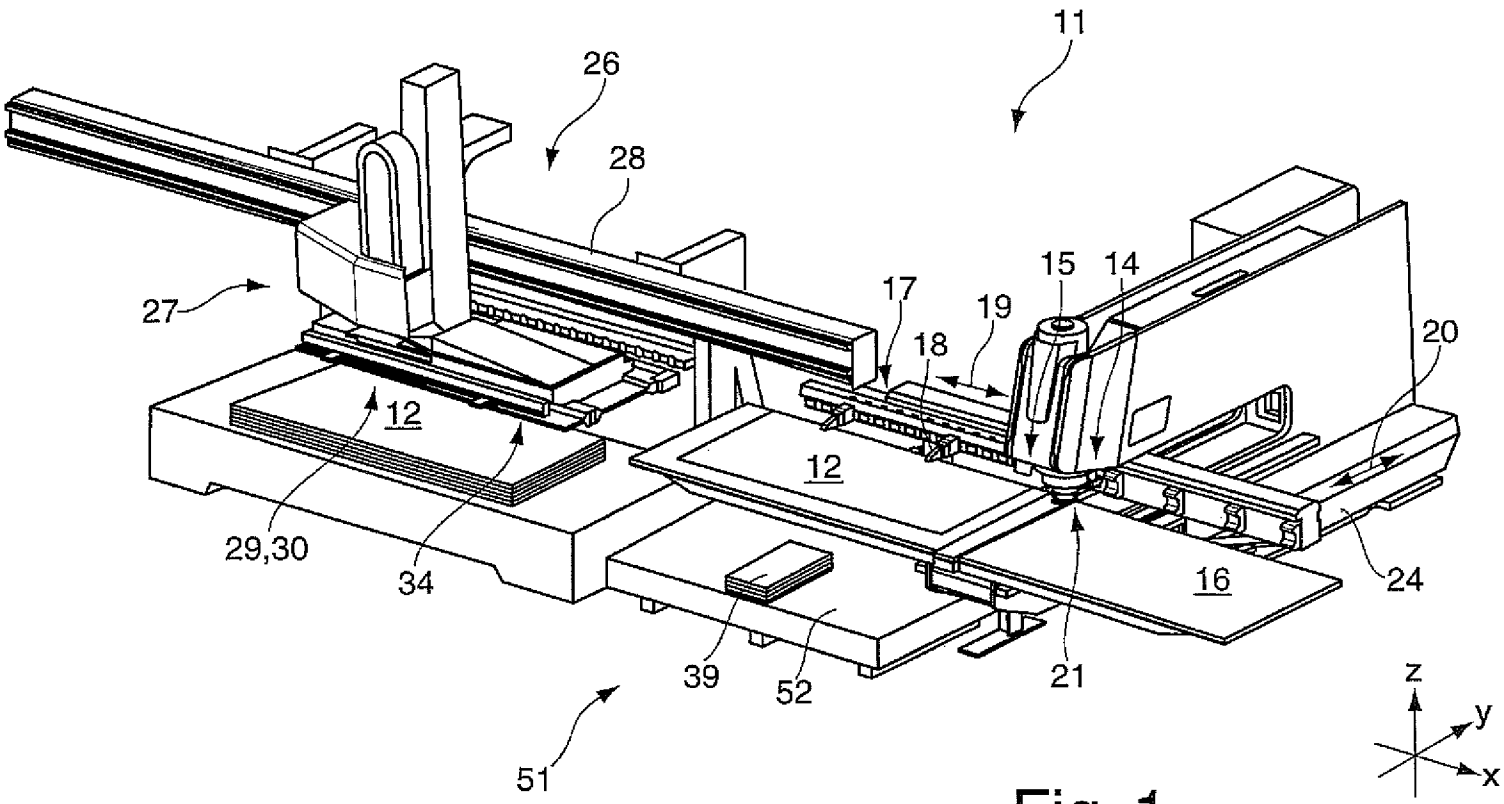
FIG. 1 is a perspective view of a processing machine.

In FIG. 1, a processing machine 11 is formed, for example, as a punching machine. A preferably immovable processing device 21 having a punching head 14 and having a punching stamp that is not depicted in more detail is provided for the separation processing of a planar workpiece 12, for example, in the form of a sheet of metal. Alternatively, a laser punching machine can also be used in which a laser processing head is provided adjacent the punching head 14. The workpiece 12 to be processed lies on a workpiece support 16 during the workpiece processing. The workpiece 12 is held during the processing with a holding device 17, which preferably comprises brackets 18, and can be moved with respect to the punching head 14 in the X-direction of the workpiece plane (X/Y-plane) by means of a conventional linear drive 19, as indicated in the figure by an arrow. The workpiece 12 can be moved in the Y-direction of the workpiece plane, in that the workpiece support 16 is moved together with the holding device 17 relative to a base 24, on which the workpiece support 16 is supported, by means of a conventional linear drive 20, as indicated by another arrow. The workpiece 12 is able to be displaced in this way in both the X- and Y-direction relative to the punching head 14, such that the respective region of the workpiece 12 to be processed can be positioned in the processing region of the punching head 14, if these are present. The processing region lies between the punching head 14 and a punching matrix, which is not depicted in more detail and which is able to be exchanged. Accordingly, laser optics can be arranged in the immovable processing region of the laser processing head in a laser punching machine.

Figure 2A:
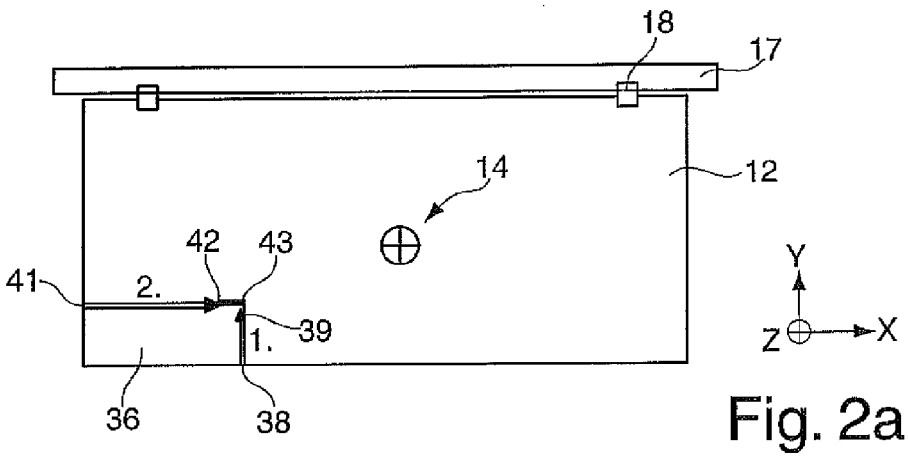
FIGS. 2*a* to 2*c* are schematic views, from above, of successive work steps to process and discharge workpieces.
Figure 2B:
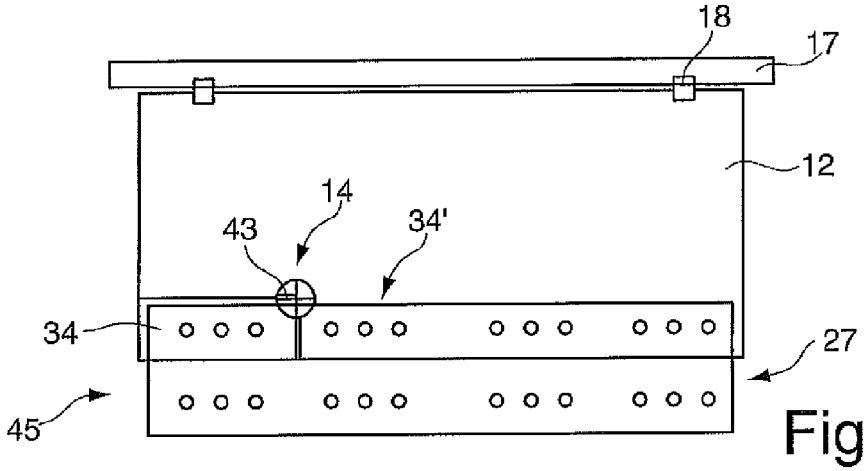
Figure 2C:
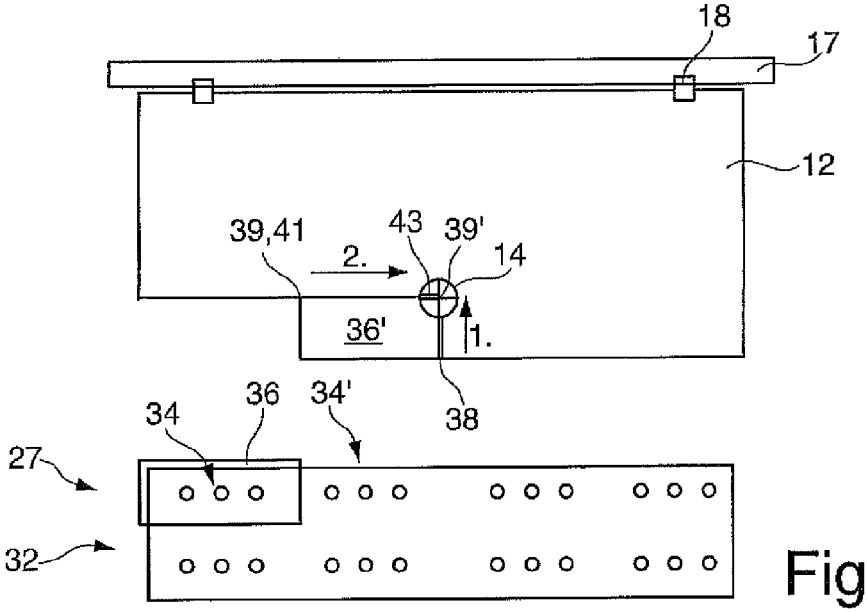

A handling device 26 is provided on the front side of the workpiece support 16 of the processing machine 11, said handling device 26 also configured to include a discharge device 27, which is configured to move along at least one linear axis 28 between a loading and unloading position 29, 30 for the planar material 12 and a discharge or waiting position 32, as shown in FIG. 2*c*.

The discharge device 27 comprises several holding elements 34, which each can be formed, for example, as a magnetic sucker, a vacuum sucker or an electro-adhesive sucker. In the exemplary embodiment a holding element 34 having several individual suckers is shown (FIG. 2*c*). Several holding elements 34 are arranged in a row one behind the other, and the size or position and width of the holding elements 34 can be determined freely by the allocation of the suckers 35 and can be adjusted to the size of the workpiece.

The holding elements 34 can be moveably driven in at least one further axis, so in a Y and/or Z axis, along the X-Y-Z coordinate system, which is depicted in FIG. 1, having at least one linear drive.

In FIG. 2*a*, the planar workpiece 12 as well as the holding device 17 having the brackets 18 are depicted in a schematically enlarged view, said brackets 18 receiving the planar workpiece 12. Additionally, the punching head 14 is depicted symbolically in an initial position. This workpiece 12 lies on the workpiece support 16, which—like further components of the processing machine 11—is not depicted in more detail.

To produce a workpiece 36 from the planar material 12, the planar material 12 is moved, such that the punching head 14 is firstly situated in the position 38 in order to introduce a first cut into the planar material 12 from there, which ends in position 39. Subsequently, the planar material 12 is moved such that the punching head 14 is in position 41, in order to carry out a second cut from there, which ends in position 42. A residual connection 43 remains for a final cut.

After the first and second cuts have been carried out according to FIG. 2*a*, in order, for example, to cut free a square work piece 36, the discharge of the workpiece 36 is initiated. The discharge device 27 is moved to a receiving position 45 from a loading or unloading position 29, 30, or preferably from a waiting position 32, which is depicted in FIG. 2*c* and was assumed during the first cuts to produce the workpiece 36, such that a holding element 34, which comprises, for example, three suckers, is positioned at the workpiece 36, which is then gripped by the holding element 34. Subsequently, the final cut occurs by means of the punching head 14, or alternatively with the laser processing head, separating the residual connection 43 such that the workpiece 36 comes completely free.

Subsequent to this, the discharge device 27 is lifted at least slightly in the Z-direction and/or is led out in the Y-direction from the receiving position 45, such that the discharge device 27 in turn occupies the waiting position 32 depicted in FIG. 2*c*.

Subsequently—as is depicted in FIG. 2*c*—a subsequent workpiece 36' is cut in the same way as the first work piece 36, by means of similar first and second cuts. Due to this work method, skeleton-free processing of the planar material 12 is enabled. After the first and second cut for the subsequent workpiece 36' have been completed, leaving a residual connection 43', the discharge device 27 is positioned in the receiving position 45 above the workpiece 36' in turn by a movement in the Y-direction and/or a slight movement in the Z-direction by means of the further holding element 34', such that the holding element 34' can grasp this and the discharge device now holds two workpieces 36, 36'.

In the depicted exemplary embodiment, the length of the planar material 12 preferably corresponds to the length of the discharge device 27 or to the holding elements 34 arranged in a row, such that a row of workpieces 36 arranged one behind the other can be received by the discharge device 27. Thus an intermediate buffer is formed. After, for example, one row of holding elements 34 is filled with workpieces 36, the discharge device 27 is moved from the waiting position 32 to an unloading station 51 via the handling device 26, which, in this example, comprises a magazine 52 positioned under the workpiece support 16. Alternatively, the unloading station 51 can be positioned adjacent the loading and unloading station 29, 30 in the work region of the linear axis 28, which is able to be operated via the handling device 26. In the unloading station 51, the workpieces 36 can be deposited, for example, stacked on top of one another. Alternatively, the workpieces can be deposited simultaneously into the magazine 52 and in the way in which they are discharged from their respective receiving position 45 by the discharge device 27.

In the discharge device 27 depicted in FIG. 2*c*, for example, two rows of holding elements 34 arranged one behind the other are provided. For example, one frame receiving the holding elements 34 may be configured to rotate around 180°, such that the second row of holding elements 34 is subsequently filled after the filling of the first row of holding elements 34.

Due to this unloading strategy, in which the discharge device 27 moves between the receiving position 45 and the waiting position 32 without each individual workpiece being led away after the discharge from the processing region in the unloading station 51, an increase in productivity or in the degree of automation can be achieved. The long movement paths in the X-direction to unload the workpieces 36, 36' can be reduced in frequency.

The discharge device 27 described above can be configured to have multiple holding elements 34, each with one or several suckers 35, in which the individual holding elements 34 are configured to be moved and controlled individually or as a group in the Z-direction. This enables an analogous work method to the work method described above. Additionally, processing to produce the workpieces 36 having a remaining skeleton can occur in place of skeleton-free processing of the planar material 12. Through the ability of the holding elements 34 to move along the Z-axis, the suckers 35 can be lowered onto the workpiece 36 to be discharged.

Alternatively, in the case of a discharge device 27 with holding elements 34 that have, for example, suckers 35 or magnetic grippers, a discharge of workpieces 36 during processing with a remaining skeleton occurs, with the holding elements 34 being able to move in the Z-direction. The suction power of the suckers 35 or the magnetic force of a magnetic gripper can bridge the remaining gap, which remains in the case of a positioning of the discharge device 27, having a workpiece 36 that has already been received, to discharge a further workpiece 36', as a complete lowering of the discharge device 27 is not possible due to the remaining skeleton.

Figure 3:
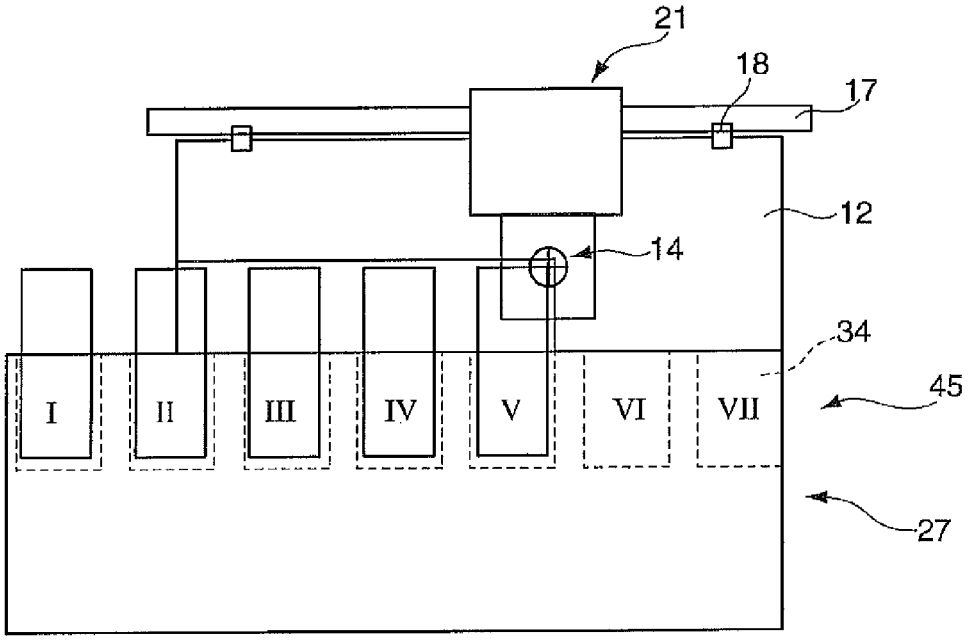
FIG. 3 is a schematic view from above of an alternative embodiment to FIGS. 2*a* to 2*c*.

In FIG. 3, an alternative embodiment is depicted in order to enable a discharge of several parts with the discharge device 27 before the punching head 14. In order to be able to move the workpieces 36 on the punching head 14 in the X-direction, it is suggested to design the discharge device 27 with a movement axis in the Y-direction, such that the discharge device 27 can also be positioned beyond the processing device 21, in order to enable a discharge of several parts. The movement of the discharge device 27 can occur analogously to the movement described in FIGS. 2*a* to 2*c*. The holding elements 34 in this embodiment can be, for example, a group of suckers 35 arranged at a distance to one another.

Figure 4:
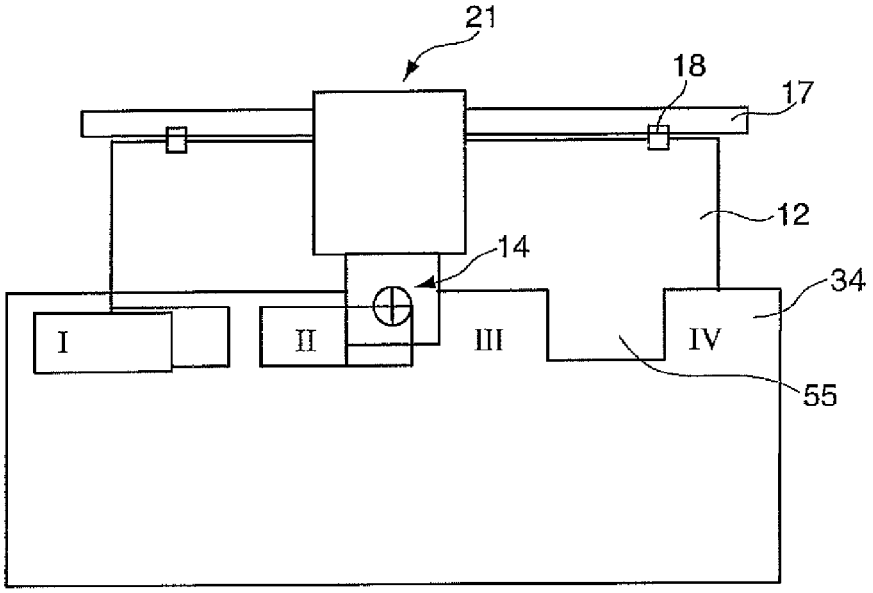
FIG. 4 is a further schematic view from above of an alternative embodiment to FIG. 3.

In FIG. 4, a further alternative embodiment for an unloading strategy is depicted, in which a receiving position 45 or unloading position is provided next to the punching head 14. The holding elements 34 are at a distance to one another in order to form a free space or a gap 55 between them, which enables an at least partial receiving of the punching head 14 within the gap 55 in the case of a movement of the discharge device 27 in the Y-direction. Thus, the holding elements 34 can be positioned laterally to the punching head 14, in order to discharge workpieces 36, 36'. To discharge the workpiece 36, 36', the discharge device 27 is moved in the Y-direction, with a short simultaneous or preliminary movement in the Z-direction.

Figure 5:
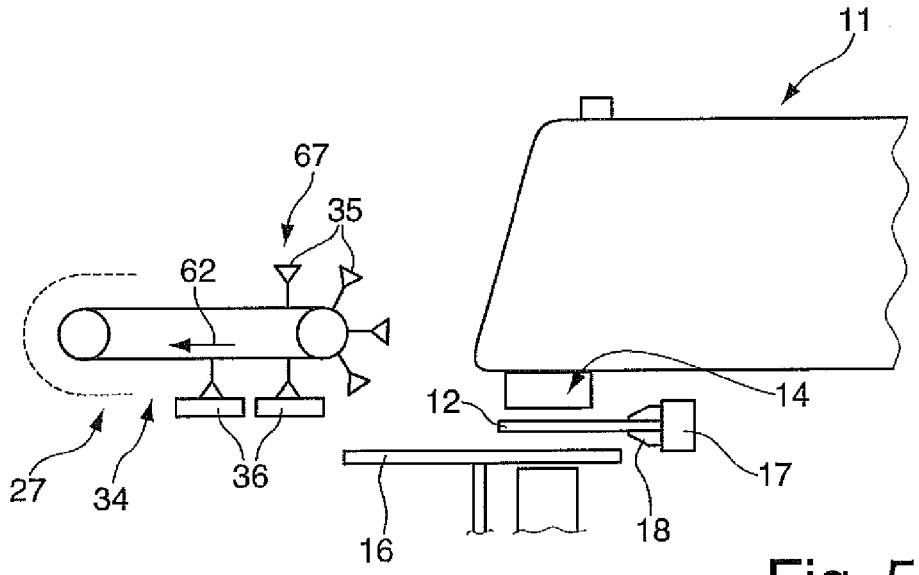
FIG. 5 is a schematic side view of an alternative embodiment of the discharge device.

In FIG. 5, a schematic side view of an alternative embodiment of the discharge device 27 is depicted. This discharge device has a rotating band or a chain 61, on which a plurality of suckers 35 are arranged, in place of several holding elements 34 arranged in a plane having suckers 35. This discharge device 27 is transferred to the receiving position 45, such that the next free sucker 35 can discharge the workpiece 36. Subsequently, the discharge device 27 is again moved to the waiting position 32 and the chain 61 is rotated in the direction of the arrow 62, such that the next free sucker 35 is provided for receiving. This arrangement has the advantage that an intermediate buffer 67 is created in turn by such a chain 61 with suckers 35 or grippers.

Additionally, such a chain 61 can be formed narrowly with suckers 35 arranged thereon. The possibility also exists that several chains 61 with suckers 35 arranged thereon are arranged in a row next to one another and form a discharge device 27, said suckers 35 being used one after the other.

Figure 6:
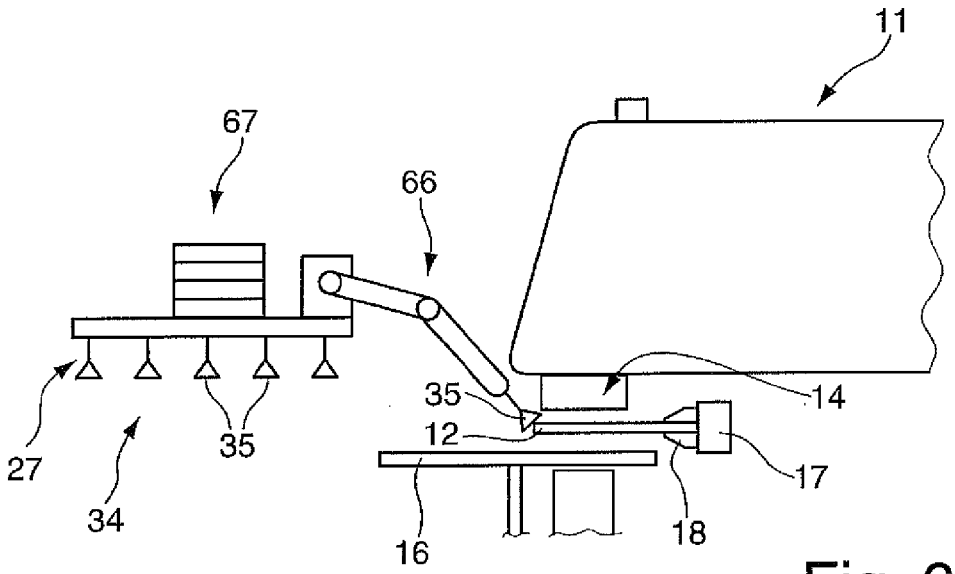
FIG. 6 is a schematic side view of a further alternative embodiment of the discharge device.

In FIG. 6, a further alternative embodiment of the discharge device 27 is depicted. This version of the discharge device 27 comprises a holding element 34, which is formed as a suction frame, in order to, for example, discharge the planar material 12 from the loading position 29 and to supply it to the processing region. Additionally, unloading equipment or a handling robot 66 is arranged on the suction frame, which is formed, for example, as a uni or multi-axial robot, which comprises a gripper. The gripper can be formed as a suction gripper or a magnetic gripper. After the discharge of the workpiece 36, it is transferred via the handling robot 66 to the intermediate buffer 67. The buffer can, for example, be a storage space on the back side or the upper side of the suction frame of the holding elements 34, configured to receive the produced workpieces 36.

Both embodiments of the discharge device 27 are suitable for both skeleton-free processing and processing of the planar material in which a skeleton remains, which is removed in its entirety from the processing region after the production of the workpiece or is already reduced after the production of the respective workpiece and is continuously removed via an opening in the workpiece support 16.

The invention claimed is:

1. A Method of processing and discharging workpieces from planar material, the method comprising:

cutting a first workpiece from the planar material with a processing device in a processing region of a processing machine, while the planar material is supported on a workpiece support, leaving a residual connection between the first workpiece and adjacent planar material;

positioning a discharge device in a receiving position in which a first of multiple holding elements of the discharge device is positioned to receive the first workpiece;

holding the first workpiece with the first holding element in the receiving position;

with the first workpiece held, severing the residual connection to separate the first workpiece from the adjacent planar material;

moving the discharge device from the receiving position to a waiting position outside and adjacent the processing region while the first workpiece is held;

cutting a further workpiece from the planar material with the processing device, while the planar material is supported on the workpiece support, leaving a further residual connection between the further workpiece and the adjacent planar material;

moving the discharge device from the waiting position to a receiving position for the further workpiece;

holding the further workpiece with another of the holding elements of the discharge device in the receiving position for the further workpiece;

with the further workpiece held, severing the further residual connection to separate the further workpiece from the adjacent planar material; and then moving the discharge device to an unloading station and unloading the first and further workpieces from the discharge device.

2. The method of claim 1, wherein, after the residual connection is severed, the discharge device is lifted in the Z-direction and moved in either or both of the X- and Y-directions to a position corresponding to either the receiving position for the further workpiece or to the waiting position.

3. The method of claim 2, further comprising determining a movement path of the discharge device from the receiving position of the first workpiece to the receiving position of the further workpiece as a function of an X-dimension of the further workpiece.

4. The method of claim 2, wherein moving the discharge device to the receiving position for the further workpiece comprises orienting the discharge device in accordance with a contact spacing of the holding elements of the discharge device.

5. The method of claim 1, wherein the first and further workpieces are produced successively from the planar material along a lateral edge of the planar material and received by the holding elements of the discharge device one after the other and in the same order as produced.

6. The method of claim 1, further comprising determining a movement path between the waiting position and the receiving position for the further workpiece as a function of contact spacing of the holding elements of the discharge device and workpiece size.

7. The method of claim 1, wherein unloading the workpieces comprises depositing all workpieces received by the discharge device in the unloading station either simultaneously, individually one after the other, or in a stack.

8. The method of claim 1, wherein the workpieces are stored in an intermediate buffer of the discharge device after discharge from the processing region.

9. The method of claim 1, wherein cutting of the first and further workpieces from the planar material is carried out by skeleton-free processing.

10. The method of claim 1, wherein the planar material comprises a plate-like material.

11. The method of claim 1, wherein the planar material comprises a sheet of metal.

* * * * *